US008888235B2

(12) United States Patent
Kobayashi

(10) Patent No.: US 8,888,235 B2
(45) Date of Patent: Nov. 18, 2014

(54) LIQUID EJECTING APPARATUS

(71) Applicant: Seiko Epson Corporation, Tokyo (JP)

(72) Inventor: Kazuhiro Kobayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/066,561

(22) Filed: Oct. 29, 2013

(65) Prior Publication Data

US 2014/0125734 A1 May 8, 2014

(30) Foreign Application Priority Data

Nov. 7, 2012 (JP) ..... 2012-245103

(51) Int. Cl.
*B41J 2/165* (2006.01)

(52) U.S. Cl.
CPC ..... *B41J 2/16535* (2013.01); *B41J 2002/1655* (2013.01)
USPC ..... 347/33; 347/32

(58) Field of Classification Search
CPC ..... B41J 2/16508; B41J 2/16535; B41J 2/16538; B41J 2/16588; B41J 2002/1655
USPC ..... 347/22, 30, 31, 32, 33, 35
See application file for complete search history.

(56) References Cited

U.S. PATENT DOCUMENTS

| | | | | |
|---|---|---|---|---|
| 6,382,767 | B1 * | 5/2002 | Greive | 347/30 |
| 7,296,874 | B2 * | 11/2007 | Horio et al. | 347/31 |
| 8,328,326 | B2 * | 12/2012 | Inoue | 347/33 |
| 8,342,639 | B2 * | 1/2013 | Inoue | 347/33 |
| 2010/0245466 | A1 | 9/2010 | Inoue | |

FOREIGN PATENT DOCUMENTS

| | | |
|---|---|---|
| JP | 2006-198509 | 8/2006 |
| JP | 2010-234667 | 10/2010 |
| JP | 2010-234668 | 10/2010 |
| JP | 2012-051140 | 3/2012 |
| JP | 2012-126090 | 7/2012 |

* cited by examiner

*Primary Examiner* — Anh T. N. Vo
(74) *Attorney, Agent, or Firm* — Workman Nydegger

(57) ABSTRACT

A liquid ejecting apparatus includes a liquid ejecting head that includes a nozzle formation surface on which a plurality of nozzles which eject a liquid are formed to be lined up in one direction to form nozzle columns, a belt-shaped member that is brought into contact with the nozzle formation surface, and a belt-shaped member contact portion that brings the belt-shaped member into contact with the nozzle formation surface in both a first contact state where the belt-shaped member is brought into contact with a partial area of the nozzle formation surface and a second contact state where the belt-shaped member is in contact with an area corresponding to the nozzle column in a direction along the nozzle column on the nozzle formation surface.

7 Claims, 7 Drawing Sheets

LIQUID EJECTING APPARATUS

BACKGROUND

1. Technical Field

The present invention relates to a liquid ejecting apparatus, and more particularly, to a technique with which to clean a nozzle formation surface of a liquid ejecting head.

2. Related Art

In the related art, an ink jet printer that ejects a liquid from a plurality of nozzles which are formed on a nozzle formation surface of a liquid ejecting head to an ejection target medium which is transported such as paper to form an image is known as a type of liquid ejecting apparatus. Such a printer is provided with a cleaning function in many cases so as to maintain the ejection characteristics of the liquid from the nozzle and clean the nozzle formation surface by removing the unnecessary portion of the liquid which is adhered to the nozzle or the nozzle formation surface.

In an example of the configuration of the cleaning function for the nozzle formation surface, the cleaning is performed by using a belt-shaped member which can capture the liquid. In other words, the liquid adhered to the nozzle or the nozzle formation surface is removed and the nozzle formation surface is cleaned by bringing a part of the belt-shaped member (belt member) into contact with the nozzle portion which is formed on the nozzle formation surface of the liquid ejecting head or by bringing a part of the belt-shaped member into contact with a part of the nozzle formation surface (ejection surface) near the nozzle (for example, refer to JP-A-2012-126090).

In many cases, a plurality of nozzles are lined up in one direction to form nozzle columns on the nozzle formation surface. Accordingly, in a configuration in which a part of the belt-shaped member is in contact with a part of the nozzle formation surface for the cleaning, a partial contact portion of the belt-shaped member is configured to be moved across the whole area of the nozzle formation surface in the direction along the nozzle columns so as to clean all of the nozzles. In this case, for example, where the area of the nozzle formation surface which is a cleaning target is approximately the whole area of the nozzle columns, the belt-shaped member, a part of which is moved as a contact portion with respect to the nozzle formation surface, cannot sufficiently capture the liquid adhered across the whole area of the nozzle formation surface only with a partial member area which is the contact portion, and thus there may be a case where the liquid remains on the nozzle formation surface. Therefore, the nozzle formation surface is unlikely to be appropriately cleaned.

Such a situation is not limited to the ink jet printer but is common to most liquid ejecting apparatuses that include a belt-shaped member which is in contact with a nozzle formation surface to clean the nozzle formation surface in a liquid ejecting head which has the nozzle formation surface on which a nozzle is formed to eject a liquid.

SUMMARY

An advantage of some aspects of the invention is to provide a liquid ejecting apparatus that can appropriately clean a nozzle formation surface by using a belt-shaped member.

Hereinafter, the following means of the invention and the operation and effects thereof will be described.

According to an aspect of the invention, a liquid ejecting apparatus includes a liquid ejecting head that includes a nozzle formation surface on which a plurality of nozzles which eject a liquid to an ejection target medium which is transported are formed to be lined up in one direction to form nozzle columns, a belt-shaped member that is provided to be capable of being in contact with the nozzle formation surface and to be brought into contact with the nozzle formation surface so as to be capable of capturing the liquid from the nozzle formation surface, and a belt-shaped member contact portion that brings the belt-shaped member into contact with the nozzle formation surface in both a first contact state where the belt-shaped member is brought into contact with a partial area of the nozzle formation surface and a second contact state where the belt-shaped member is in contact with an area corresponding to the nozzle column in a direction along the nozzle column on the nozzle formation surface by moving the belt-shaped member from a separation position where the belt-shaped member is not in contact with the nozzle formation surface.

According to the configuration, in a state where the liquid is adhered to the nozzle formation surface, the nozzle formation surface to which the liquid is adhered can be appropriately cleaned by being in contact with the first contact state where the belt-shaped member is in contact with the partial area of the nozzle formation surface or in the second contact state where the belt-shaped member is in contact with the area corresponding to the nozzle columns in the direction along the nozzle columns.

It is preferable that, in the liquid ejecting apparatus, the belt-shaped member contact portion include a contact member that is in contact with the belt-shaped member from the side opposite to a side on which the nozzle formation surface is in contact with the belt-shaped member so that the belt-shaped member is in contact with the nozzle formation surface in either one of the first contact state and the second contact state.

According to the configuration, in a state where the liquid is adhered to the nozzle formation surface, the belt-shaped member can be easily in contact with the portion of the nozzle formation surface where the liquid needs to be removed since the contact member is in contact with the belt-shaped member from the side opposite to the side on which the nozzle formation surface is in contact with the belt-shaped member. As a result, the nozzle formation surface can be easily cleaned.

It is preferable that, in the liquid ejecting apparatus, the belt-shaped member contact portion further include a contact member moving unit that relatively moves the contact member along the nozzle formation surface with respect to the belt-shaped member.

According to the configuration, the contact member is moved according to the position of the nozzle (or nozzle column) on the nozzle formation surface that should be cleaned, and thus the belt-shaped member can be brought into contact with each of the nozzles so that the nozzle formation surface can be appropriately cleaned.

It is preferable that, in the liquid ejecting apparatus, the belt-shaped member contact portion include a relative movement unit that relatively moves the belt-shaped member with respect to the nozzle formation surface in a state where the belt-shaped member is in contact with the nozzle formation surface.

According to the configuration, the nozzle formation surface can be partially wiped by relatively moving the belt-shaped member with respect to the nozzle formation surface in the first contact state or the whole area of the nozzle formation surface can be wiped by relatively moving the belt-shaped member with respect to the nozzle formation surface in the second contact state. Accordingly, the nozzle formation surface can be appropriately cleaned by wiping.

It is preferable that, in the liquid ejecting apparatus, the relative movement unit have a belt-shaped member moving unit that moves the belt-shaped member in the direction along the nozzle column.

According to the configuration, the nozzle formation surface is not moved but the belt-shaped member is moved along the nozzle columns with respect to the nozzle formation surface, and the liquid that is adhered to the nozzle column which is the cleaning target can be prevented from moving to and being mixed with another one of the nozzle columns by wiping in a case, for example, where the plurality of nozzle columns are juxtaposed on the nozzle formation surface.

It is preferable that, in the liquid ejecting apparatus, the relative movement unit have a liquid ejecting head moving unit that moves the liquid ejecting head in the direction crossing the direction in which the ejection target medium is transported.

According to the configuration, the belt-shaped member is not moved but the liquid ejecting head is moved so that the belt-shaped member can be relatively moved with respect to the nozzle formation surface.

It is preferable that, in the liquid ejecting apparatus, the liquid ejecting head be moved by the liquid ejecting head moving unit and the belt-shaped member be moved by the belt-shaped member moving unit in the direction crossing the direction of movement of the liquid ejecting head by the liquid ejecting head moving unit in the relative movement unit.

According to the configuration, the liquid ejecting head and the belt-shaped member are moved, and thus the direction of relative movement between the belt-shaped member and the nozzle formation surface can be changed without having to be a certain direction such as the direction of movement of the liquid ejecting head. Accordingly, the direction in which a lyophobic surface or the like provided on the nozzle formation surface is rubbed by the belt-shaped member can be dispersed, and thus a degradation in the lyophobic performance of the nozzle formation surface generated by the rubbing in the same direction can be prevented and the nozzle formation surface can be appropriately cleaned by the belt-shaped member.

BRIEF DESCRIPTION OF THE DRAWINGS

The invention will be described with reference to the accompanying drawings, wherein like numbers reference like elements.

FIGS. 2A to 2C are pattern views showing the configuration of a wiper unit of the printer of an embodiment, in which FIG. 2A is a right side view of the wiper unit, FIG. 2B is a schematic configuration view of a clutch mechanism that is disposed in a contact member which brings a cloth wiper into contact with a nozzle formation surface, and FIG. 2C is a schematic configuration view of an expansion and contraction mechanism that is disposed in the contact member.

FIGS. 3A and 3B are pattern views of the wiper unit showing a state where the cloth wiper is brought into contact with the nozzle formation surface in a first contact state, in which FIG. 3A is a side view thereof and FIG. 3B is a plan view thereof.

FIGS. 4A and 4B are pattern views of the wiper unit showing a state where the cloth wiper is brought into contact with the nozzle formation surface in a second contact state, in which FIG. 4A is a side view thereof and FIG. 4B is a plan view thereof.

FIG. 6A is a plan view of the wiper unit illustrating a relative movement of the nozzle formation surface and the cloth wiper and FIGS. 6B and 6C are pattern plan views showing the direction of movement of the cloth wiper in a state where a liquid ejecting head is seen through.

DESCRIPTION OF EXEMPLARY EMBODIMENTS

Figure 1:
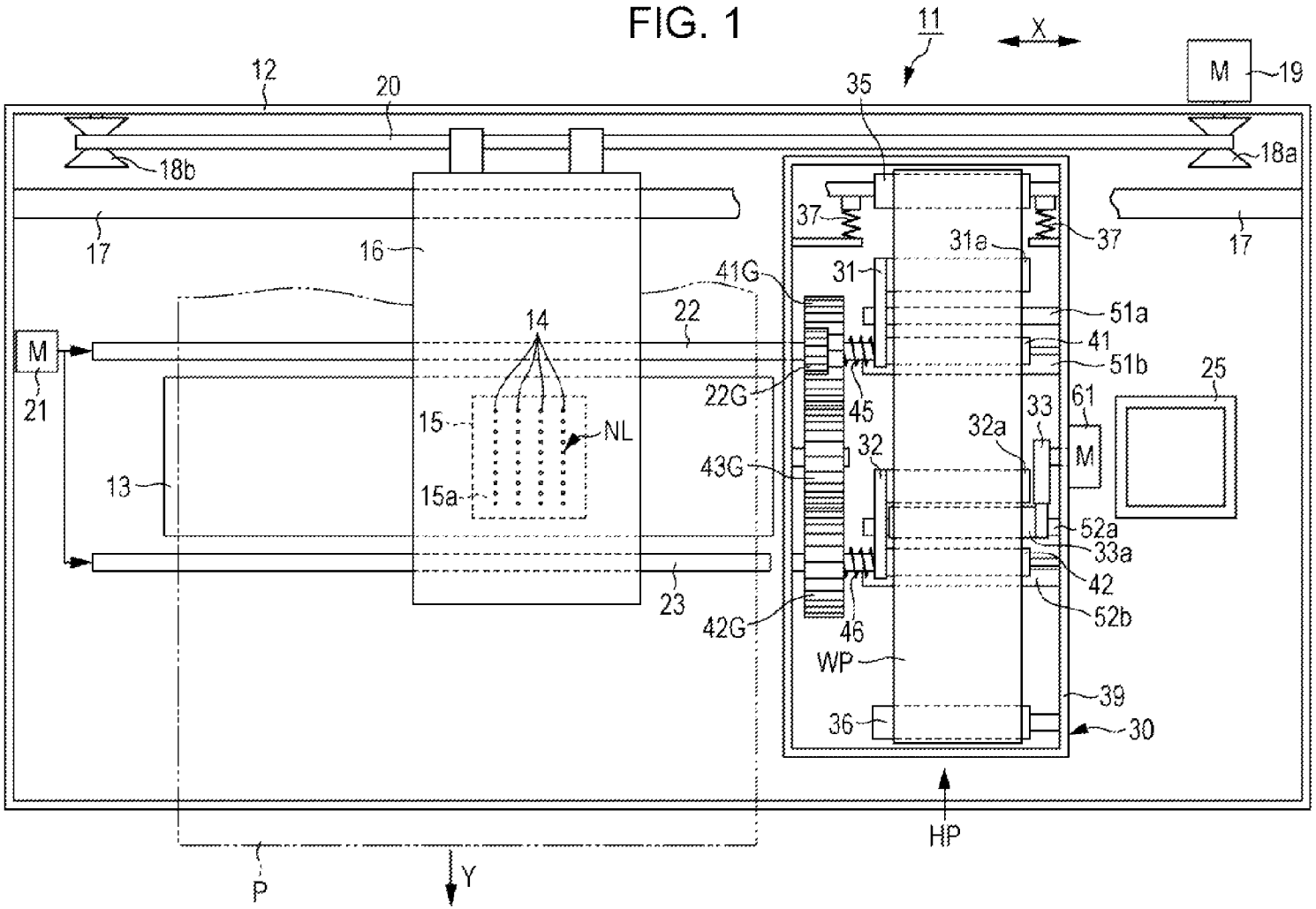
FIG. 1 is a schematic configuration view of a printer that is an example of a liquid ejecting apparatus.

An embodiment of an ink jet printer (hereinafter referred to as "printer" in some cases) that is an example of a liquid ejecting apparatus will be described referring to the drawings.

As shown in FIG. 1, a printer 11 is disposed in a lower portion that is the gravity direction (direction from the front to the back of the paper surface in FIG. 1) on an inner side of an approximately rectangular box-shaped frame 12 which has the longitudinal direction in a state where the longitudinal direction of an approximately rectangular plate-shaped support base 13 that supports paper P which is an example of an ejection target medium matches the longitudinal direction of the frame 12. A carriage 16 that supports a liquid ejecting head 15 is provided above in the anti-gravity direction of the support base 13 to be capable of reciprocating in the longitudinal direction of the frame 12. The liquid ejecting head 15 has a nozzle formation surface 15*a* that is formed in a state where a plurality of nozzles NL which eject a liquid are lined up in one direction in nozzle columns 14, and is attached to a lower surface side of the carriage 16 so that the nozzle formation surface 15*a* opposes the support base 13.

A bar-shaped guide shaft 17 is disposed in the frame 12 to extend in parallel with the longitudinal direction of the support base 13, and the carriage 16 is supported by the guide shaft 17 to be capable of reciprocating in the axis direction thereof. A driving pulley 18*a* and a driven pulley 18*b* are pivotably supported by respective positions corresponding to both end portions of the guide shaft 17 in an inner surface of a side wall portion extending in the longitudinal direction of the frame 12. An output shaft of a carriage motor 19 that is an example of a driving source which is used when causing the carriage 16 to reciprocate is connected to the driving pulley 18*a*. Between the driving pulley 18*a* and the driven pulley 18*b*, an endless-shaped timing belt 20 partially connected to the carriage 16 is mounted across. Accordingly, the carriage 16 can be moved in the axis direction of the guide shaft 17 via the endless-shaped timing belt 20 by a driving force of the carriage motor 19 while being guided by the guide shaft 17. The axis direction of the guide shaft 17 is referred to as a main scanning direction X.

On both horizontal-direction sides that pinch the support base 13, the horizontal direction being the direction crossing the main scanning direction X which is the longitudinal direction of the support base 13, a paper feed roller 22 that is rotation-driven by a paper feed motor 21 which is an example of the driving source and a paper discharge roller 23 are arranged in a state where the axis direction of each roller shaft matches the main scanning direction X. The paper P is transported onto the support base 13 by being moved while being pinched between the paper feed roller 22 and a driven roller, which is not shown herein, in response to a rotation of the paper feed roller 22. The direction in which the paper P is transported is referred to as a sub-scanning direction Y.

In the printer 11, ink that is an example of the liquid is ejected from the nozzles NL to the paper P which is transported onto the support base 13 so as to form an image or the like. In the carriage 16, a predetermined number of ink cartridges (not shown) that store the ink which is supplied to the liquid ejecting head 15 are removably mounted. On the nozzle formation surface 15*a* of the liquid ejecting head 15, the plurality of nozzles NL are formed as the plurality of nozzle columns 14 (four columns herein) that are lined up in the sub-scanning direction Y as the one direction at a predetermined gap in the main scanning direction X so as to eject the ink that is stored in the ink cartridges which are mounted. The liquid ejecting head 15 is moved by the carriage 16 while ejecting the ink supplied from the ink cartridges from the nozzles NL which are formed on the nozzle formation surface 15*a* to the paper P which is transported onto the support base 13 so as to form the image or the like on the paper P.

Accordingly, components of the printer 11 that move the carriage 16 such as the above-described carriage motor 19 and the guide shaft 17 function as liquid ejecting head moving units that move the liquid ejecting head 15 attached to the carriage 16 in the direction crossing the direction in which the paper P is transported.

The paper P on which the image or the like is formed is discharged from the printer 11 by the paper discharge roller 23 which is arranged on a downstream side in the sub-scanning direction Y with respect to the support base 13. In the embodiment, description relating to the configuration of a driving mechanism thereof will be omitted. The paper discharge roller 23, as is the case with the paper feed roller 22, is rotation-driven by the paper feed motor 21, and the paper P is moved while being pinched between the paper discharge roller 23 and the driven roller, which is not shown herein, and is discharged from the printer 11 by the rotation of the paper discharge roller 23.

As shown in FIG. 1, an area of the frame 12 other than an area where the paper P is transported is a home position HP where the carriage 16 is placed when the image is not formed in the printer 11. Maintenance of the liquid ejecting head 15 is performed in the home position HP.

At the home position HP, a wiper unit 30 that has an endless-shaped cloth wiper WP which is an example of a belt-shaped member capable of capturing the ink, and a cap 25 that is in contact with the liquid ejecting head 15 to surround the nozzles NL (nozzle columns 14) are provided. The wiper unit 30 is provided with a belt-shaped member contact portion that moves the cloth wiper WP and selectively brings the cloth wiper WP into contact with both a part and the whole of the area of the nozzle formation surface 15*a*. The nozzle formation surface 15*a* to which the ink is adhered is cleaned by the cloth wiper WP that is in contact. In a state where the cap 25 is in contact with the liquid ejecting head 15, a suction pump (not shown) that is provided in the printer 11 is driven and suctions the ink from the nozzles NL of the liquid ejecting head 15 to discharge an unnecessary portion of the ink such as thickened ink.

Next, the configuration of the wiper unit 30 that is provided with the belt-shaped member contact portion will be described referring to FIG. 1 and FIGS. 2A to 2C. In the wiper unit 30 of the embodiment, the cloth wiper WP uses a fiber-based member such as fabric and a thread formed of natural fiber, chemical fiber, or the like, and is in contact with the nozzle formation surface 15*a* of the liquid ejecting head 15 so as to be capable of capturing the ink which is adhered to the nozzle formation surface 15*a* by absorbing or adhering the ink.

Figure 2A:
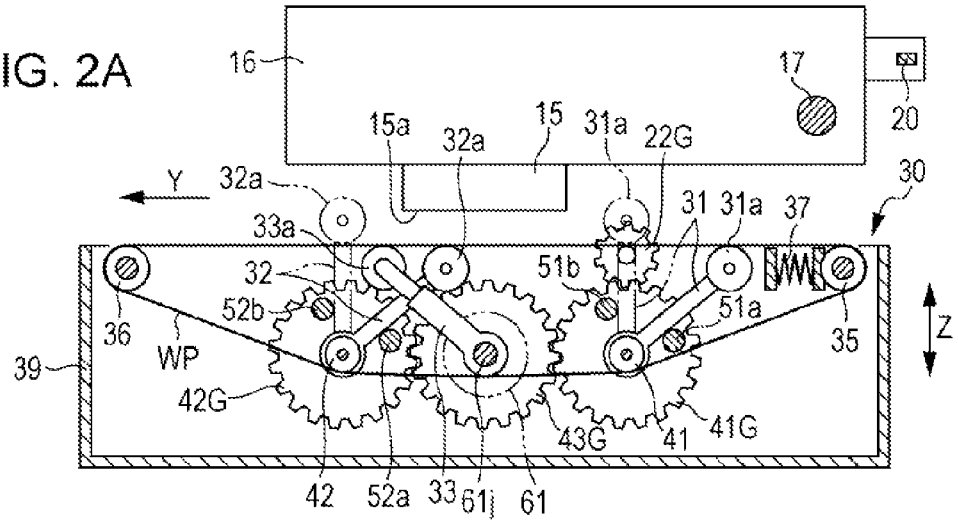

As shown in FIG. 1 and FIG. 2A, a pair of support rollers 35 and 36 that have axes which extend approximately horizontally in the direction along the main scanning direction X are pivotally supported in a rotatable manner in approximately both end portions in the sub-scanning direction Y in an approximately box-shaped unit case 39 that constitutes the exterior of the wiper unit 30. Between the pair of support rollers 35 and 36, the cloth wiper WP that has a width dimension corresponding to the whole area in the direction along the nozzle columns 14 of the nozzle formation surface 15*a* is mounted across. In the embodiment, one support roller 35 of the pair of support rollers 35 and 36 is biased by a biasing member 37 such as a spring so that the endless-shaped, that is, ring-shaped cloth wiper WP that is mounted across constantly remains in a stretched state.

In the unit case 39, a first driving roller 41 and a second driving roller 42 that are pivotally supported in a pivotable manner while having axes that extend approximately horizontally in the direction along the main scanning direction X and are in contact with the cloth wiper WP which is stretched in a ring shape from an inner side of the ring are also provided. The cloth wiper WP that is mounted across between the pair of support rollers 35 and 36 is configured to be moved in the belt direction which is orthogonal to the width direction and to be turned by a rotation of the first driving roller 41 or the second driving roller 42 in the wiper unit 30.

In the embodiment, a first gear 41G and a second gear 42G are respectively fixed to support base 13 side end portions of the first driving roller 41 and the second driving roller 42. An intermediate gear 43G that is engaged with both of the first gear 41G and the second gear 42G is rotatably attached to the unit case 39, and the first gear 41G and the second gear 42G are configured to rotate in the same direction in conjunction with each other via the intermediate gear 43G. A transmission gear 22G that is provided at an axial end of the paper feed roller 22 is engaged with the first gear 41G. The first gear 41G and the second gear 42G are configured to rotate at the same time via the transmission gear 22G which is engaged in response to the rotation of the paper feed roller 22.

The number of the intermediate gear 43G is one in the embodiment, but the number may be an odd number greater than one. The first gear 41G and the second gear 42G are configured to have gears having the same pitch diameter so as to rotate synchronously at the same angle of rotation and at the same direction of rotation.

Figure 2B:
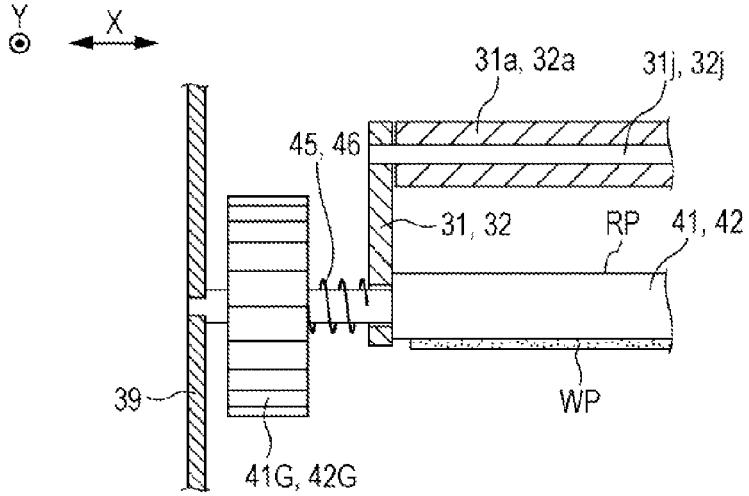

As shown in FIGS. 2A and 2B, a first arm member 31 is provided between a roller portion RP that is in contact with the cloth wiper WP and the first gear 41G in the first driving roller 41, one end side thereof being pivotally supported to be capable of oscillating about a roller shaft of the first driving roller 41 and the other end side thereof being attached to a first rotary roller 31*a*. The first rotary roller 31*a* can pivot about a shaft 31*j* that is fixed to the other end side of the first arm member 31.

The one end side of the first arm member 31 is biased by a coil spring 45 that is an example of the biasing member so as to be pressed against the roller portion PR side constantly. The first arm member 31 rotates, that is, oscillates together with the first driving roller 41 due to a frictional force generated between the first arm member 31 and the roller portion RP. The oscillation causes the first rotary roller 31*a* that is attached to the other end side of the first arm member 31 to revolve about the axis of rotation of the first driving roller 41. The first rotary roller 31*a* is placed on the inner side of the ring of the cloth wiper WP and can pivot about an axis which is in parallel with the pair of support rollers 35 and 36.

Likewise, a second arm member 32 is provided between the roller portion RP that is in contact with the cloth wiper WP and the second gear 42G in the second driving roller 42, one end side thereof being pivotally supported to be capable of oscillating about a roller shaft of the second driving roller 42 and the other end side thereof being attached to a second rotary roller 32*a*. The second rotary roller 32*a* can pivot about a shaft 32*j* that is fixed to the other end side of the second arm member 32.

The one end side of the second arm member 32 is biased by a coil spring 46 that is an example of the biasing member so as to be pressed against the roller portion PR side constantly. The second arm member 32 rotates, that is, oscillates together with the second driving roller 42 due to a frictional force generated between the second arm member 32 and the roller portion RP. The oscillation causes the second rotary roller 32*a* that is attached to the other end side of the second arm member 32 to revolve about the axis of rotation of the second driving roller 42. The second rotary roller 32*a* is placed on the inner side of the ring of the cloth wiper WP and can pivot about the axis which is in parallel with the pair of support rollers 35 and 36.

As shown with the solid line and the two-dot chain line in FIG. 2A, each of the first arm member 31 and the second arm member 32 of the embodiment has a limited range of oscillation. The oscillation of the first arm member 31 is limited so that the rotation together with the first driving roller 41 caused by the frictional force is not possible by the first arm member 31 being in contact with the other end sides of angular contact pins 51*a* and 51*b* whose respective one end sides are fixed to the opposite side to the support base 13 side of the unit case 39 of the wiper unit 30. Likewise, the oscillation of the second arm member 32 is limited so that the rotation together with the second driving roller 42 caused by the frictional force is not possible by the second arm member 32 being in contact with the other end sides of angular contact pins 52*a* and 52*b* whose respective one end sides are fixed to the opposite side to the support base 13 side of the unit case 39 of the wiper unit 30.

In the embodiment, in a case where the direction of rotation of the paper feed roller 22 is the direction of rotation at the time when the paper P is transported in the sub-scanning direction Y, oscillation positions of the first arm member 31 and the second arm member 32 are maintained at positions where the first rotary roller 31*a* and the second rotary roller 32*a* are apart from the cloth wiper WP as shown with the solid line in FIG. 2A. In a case where the direction of rotation of the paper feed roller 22 is the opposite direction to the direction at the time when the paper P is transported, the oscillation positions of the first arm member 31 and the second arm member 32 are maintained at positions where the first rotary roller 31*a* and the second rotary roller 32*a* push up the cloth wiper WP to the anti-gravity direction side in a vertical direction Z as shown with the two-dot chain line in FIG. 2A.

Figure 2C:
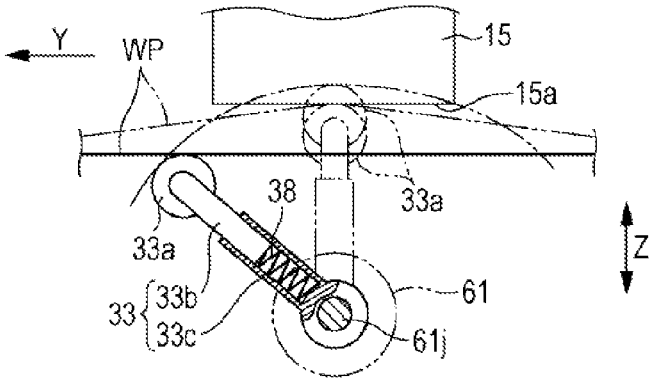

In the embodiment, a third arm member 33 that is provided with a third rotary roller 33*a* whose one end is fixed to a pivot shaft 61*j* of a driving source 61 and whose other end is attached to be capable of pivoting about the axis which is in parallel with the pair of support rollers 35 and 36 is arranged between the first driving roller 41 and the second driving roller 42 as shown in FIG. 1 and FIGS. 2A and 2C.

The third arm member 33 is not in conjunction with the first arm member 31 and the second arm member 32, but is capable of oscillating about the pivot shaft 61*j* by a driving of the driving source 61. The third arm member 33 is oscillated from a position where the third rotary roller 33*a* is apart from the cloth wiper WP as shown with the solid line in FIG. 2C to a position shown with the two-dot chain line in FIG. 2C, and brings a part of the cloth wiper WP into contact with the nozzle formation surface 15*a* by pushing up the part of the cloth wiper WP by the third rotary roller 33*a*.

At this time, the third arm member 33 is provided with an elastic structure in which the length between the third rotary roller 33*a* and the pivot shaft 61*j* of the driving source 61 can be changed as shown in FIG. 2C, and the third rotary roller 33*a* can bring the cloth wiper WP into contact with the whole area of the nozzle formation surface 15*a* in the sub-scanning direction Y. In other words, the third arm member 33 is configured in such a manner that a moving member 33*b* that is provided with the third rotary roller 33*a* and an arm base member 33*c* that is fixed to the pivot shaft 61*j* of the driving source 61 which are connected to each other via a compression spring 38 have a structure connected by the compression spring 38 and the moving member 33*b* is relatively moved with respect to the arm base member 33*c*.

The third arm member 33 is placed on the opposite side to the first arm member 31 and the second arm member 32 in the main scanning direction X of the cloth wiper WP, and is arranged in such a manner as not to buffer the first arm member 31 and the second arm member 32. The third rotary roller 33*a* is arranged on the inner side of the ring of the cloth wiper WP so as not to buffer the first rotary roller 31*a* and the second rotary roller 32*a* when the third arm member 33 oscillates and when the first arm member 31 and the second arm member 32 oscillate.

Next, an operation of the printer 11 of the embodiment will be described referring to FIGS. 3A and 3B and FIGS. 4A and 4B.

In the wiper unit 30 of the printer 11 of the embodiment, the nozzle formation surface 15*a* can be in contact with the cloth wiper WP both in a first contact state where the cloth wiper WP is in contact with the partial area of the nozzle formation surface 15*a* and in a second contact state where the cloth wiper WP is in contact with the whole area of the nozzle formation surface 15*a* in the direction along the nozzle columns 14. In FIGS. 3A and 3B and FIGS. 4A and 4B, only the configuration relating to the description of the operation is shown in the pattern views and description of the other components will be omitted.

Figure 3A:
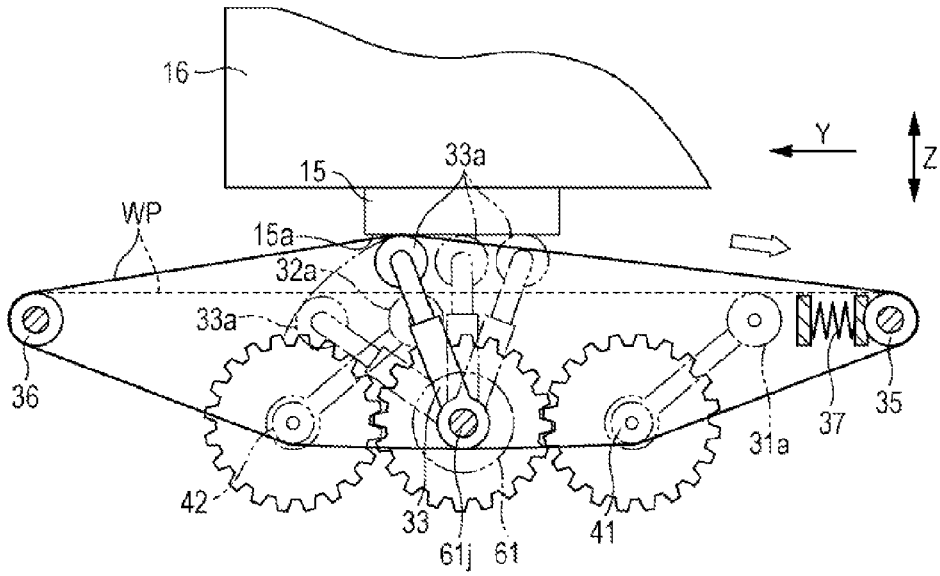
Figure 3B:
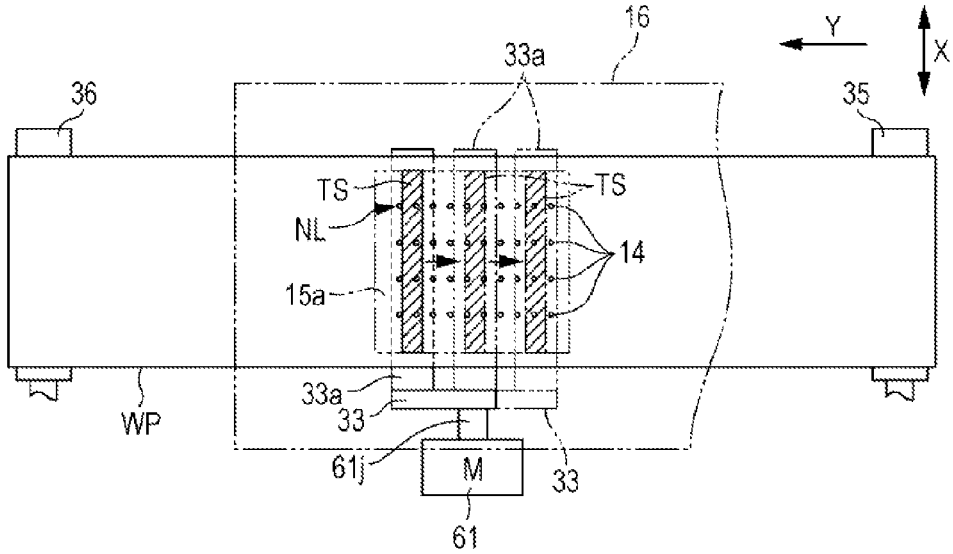

As shown in FIGS. 3A and 3B, the first contact state is achieved by causing the driving source 61 to pivot in the printer 11 and oscillating the third arm member 33. In the wiper unit 30, the cloth wiper WP is in contact with the nozzle formation surface 15*a* in the first contact state in a case where a portion of the nozzle formation surface 15*a* is cleaned by removing the ink.

In other words, the third arm member 33 is oscillated according to the angle of pivot of the driving source 61, and is in contact with the cloth wiper WP from the opposite side to the side on which the third rotary roller 33*a* provided in the third arm member 33 is in contact with the nozzle formation surface 15*a*. As shown with the thick dashed line and the solid line in FIG. 3A, the contact causes the cloth wiper WP to be moved from a separation position where the cloth wiper WP is not in contact with the nozzle formation surface 15*a* and to be brought into contact with the partial area of the nozzle formation surface 15*a* that is a cleaning target where the ink is adhered or the like.

In the embodiment, the partial area that is in contact with the cloth wiper WP is the whole area of the nozzle formation surface 15*a* in the main scanning direction X and a contact area TS that has a predetermined width in the sub-scanning direction Y, that is, the direction along the nozzle columns 14.

The contact area TS that has a predetermined width in the sub-scanning direction Y has a position that can be moved to any position in the sub-scanning direction Y of the nozzle formation surface 15*a* as shown in the hatching area surrounded by the solid line, the two-dot chain line, and the dashed line in FIG. 3B. In the first contact state, the first arm member 31 and the second arm member 32 are maintained at positions where each of the first rotary roller 31*a* and the second rotary roller 32*a* is apart from the cloth wiper WP.

In the wiper unit 30, the paper feed roller 22 can rotate in the direction in which the paper P is transported in the sub-scanning direction Y in a state where the cloth wiper WP is in contact with the nozzle formation surface 15*a* in the first contact state. As such, the cloth wiper WP can be moved in a state where the first arm member 31 and the second arm member 32 are in contact with the angular contact pin 51*a* and the angular contact pin 52*a*, that is, a state where the first rotary roller 31*a* and the second rotary roller 32*a* are maintained at positions apart from the cloth wiper WP. As a result, the cloth wiper WP is moved to be turned by the first driving roller 41 (roller portion RP) and the second driving roller 42 (roller portion RP) and is relatively moved in the opposite direction to the sub-scanning direction Y with respect to the nozzle formation surface 15*a* that is the direction along the nozzle columns 14 as shown with the white arrow in FIG. 3A.

Figure 4A:
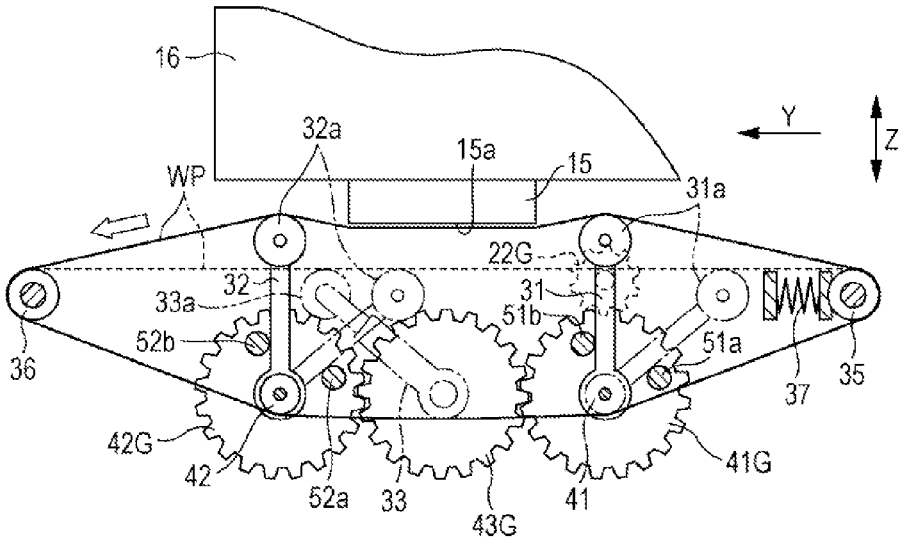
Figure 4B:
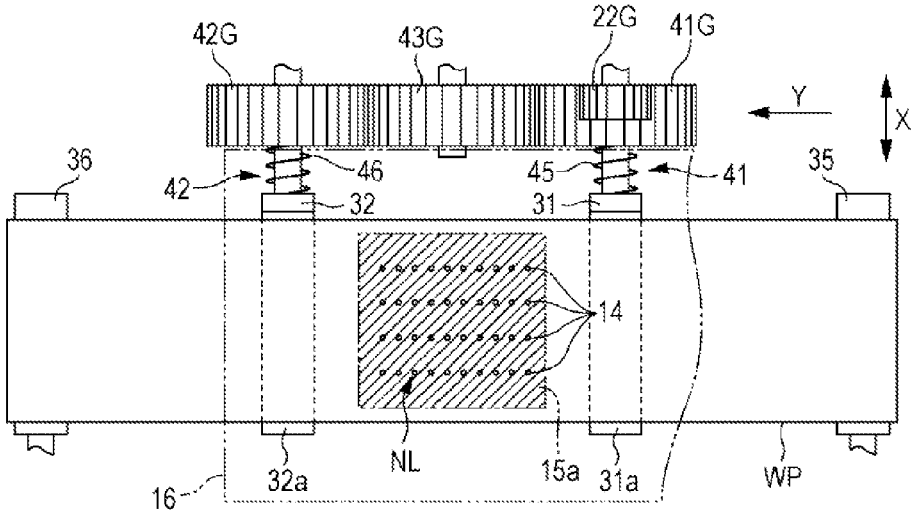

Next, as shown in FIGS. 4A and 4B, the second contact state is achieved by rotating the paper feed roller 22 in the printer 11 in the reverse direction to the direction of rotation at the time when the paper P is transported. In the wiper unit 30, the cloth wiper WP is in contact with the nozzle formation surface 15*a* in the second contact state in a case where the ink is removed from the entire nozzle formation surface 15*a* to perform the cleaning.

The first gear 41G and the second gear 42G are rotated together with each other in response to a rotation of the transmission gear 22G that is disposed in the paper feed roller 22 so as to cause the first driving roller 41 and the second driving roller 42 to rotate. As a result of the rotation, the first arm member 31 and the second arm member 32 oscillate from the state shown with the two-dot chain line in FIG. 4A toward the state shown with the solid line therein. In this case, the first rotary roller 31*a* and the second rotary roller 32*a* which are at the positions apart from the cloth wiper WP rise. Then, the first rotary roller 31*a* and the second rotary roller 32*a* provided in the first arm member 31 and the second arm member 32 are in contact with the cloth wiper WP from the opposite side to the side on which the cloth wiper WP is in contact with the nozzle formation surface 15*a*. This contact causes the cloth wiper WP to move upward from the separation position where the cloth wiper WP is not in contact with the nozzle formation surface 15*a* as shown with the thick dashed line and the solid line in FIG. 4A. As a result, the area of the cloth wiper WP between the first rotary roller 31*a* and the second rotary roller 32*a* is in contact with the whole area of the nozzle formation surface 15*a* in both of the main scanning direction X and the sub-scanning direction Y. In the second contact state, the third arm member 33 is maintained at a position where the third rotary roller 33*a* is apart from the cloth wiper WP.

Accordingly, in the second contact state, the adhered ink can be brought into contact with the whole area (area corresponding to the nozzle columns 14) of the nozzle formation surface 15*a* in the direction along the nozzle columns 14 so as to capture the ink by the cloth wiper WP in a case, for example, where the ink is adhered to all of the nozzle columns 14.

In the wiper unit 30, the first driving roller 41 and the second driving roller 42 rotate while maintaining the state where the cloth wiper WP is in contact with the whole area of the nozzle formation surface 15*a* by continuing the rotation in the reverse direction to the direction of rotation at the time when the paper feed roller 22 transports the paper P in the sub-scanning direction Y. As a result, the cloth wiper WP is moved to be turned by the first driving roller 41 (roller portion RP) and the second driving roller 42 (roller portion RP) and is relatively moved in the sub-scanning direction Y that is the direction along the nozzle columns 14 as shown with the white arrow in FIG. 4A.

As described above, in the embodiment, the first rotary roller 31*a*, the second rotary roller 32*a*, and the third rotary roller 33*a* function as contact members which are in contact with the cloth wiper WP. Also, the first arm member 31, the second arm member 32, the third arm member 33, and the oscillation mechanism (for example, the first gear 41G, the second gear 42G, and the driving source 61) that oscillates these arm members function as the belt-shaped member contact portions. Also, the first driving roller 41 and the second driving roller 42 that turn and move the cloth wiper WP function as relative movement units that relatively move the cloth wiper WP with respect to the nozzle formation surface 15*a*, and function as belt-shaped member moving units. Further, the third arm member 33 and the driving source 61 function as contact member moving units that relatively move the third rotary roller 33*a* with respect to the cloth wiper WP along the nozzle formation surface 15*a*.

According to the above-described embodiment, the following effects can be achieved.

(1) In a state where the ink is adhered to the nozzle formation surface 15*a*, the nozzle formation surface 15*a* to which the ink is adhered can be appropriately cleaned by being in contact with the first contact state where the cloth wiper WP is in contact with the partial area of the nozzle formation surface 15*a* or in the second contact state where the cloth wiper WP is in contact with the whole area in the direction along the nozzle columns 14.

(2) In a state where the ink is adhered to the nozzle formation surface 15*a*, the cloth wiper WP can be easily in contact with the portion of the nozzle formation surface 15*a* where the ink needs to be removed by bringing the first rotary roller 31*a*, the second rotary roller 32*a*, or the third rotary roller 33*a* into contact with the cloth wiper WP. As a result, the nozzle formation surface 15*a* can be easily cleaned.

(3) The cloth wiper WP can be brought into contact with the nozzle NL that should be cleaned by moving the third rotary roller 33*a* according to the position of, for example, the nozzle NL in the nozzle formation surface 15*a*. Accordingly, the nozzle formation surface 15*a* can be appropriately cleaned by the cloth wiper WP.

(4) The nozzle formation surface 15*a* can be partially wiped by relatively moving the cloth wiper WP with respect to the nozzle formation surface 15*a* in the first contact state or the whole area of the nozzle formation surface 15*a* can be wiped by relatively moving the cloth wiper WP with respect to the nozzle formation surface 15*a* in the second contact state. Accordingly, the nozzle formation surface 15*a* can be appropriately cleaned by wiping.

(5) The nozzle formation surface 15*a* is not moved but the cloth wiper WP is moved along the nozzle columns 14 with respect to the nozzle formation surface 15*a*, and the ink that is adhered to one of the nozzle columns 14 which is the cleaning target can be prevented from moving to and being mixed with another one of the nozzle columns 14 by wiping in a case, for example, where the plurality of nozzle columns 14 are juxtaposed on the nozzle formation surface 15*a*.

The above-described embodiment may be modified into another embodiment as follows.

In the first contact state of the above-described embodiment, the third rotary roller 33*a* of the third arm member 33 brings the cloth wiper WP into contact with the whole area of the nozzle formation surface 15*a* in the main scanning direction X. As such, the cloth wiper WP is in contact even with the nozzle column 14 that does not have to be cleaned in a case where the plurality of nozzle columns 14 are formed.

Figure 5A:
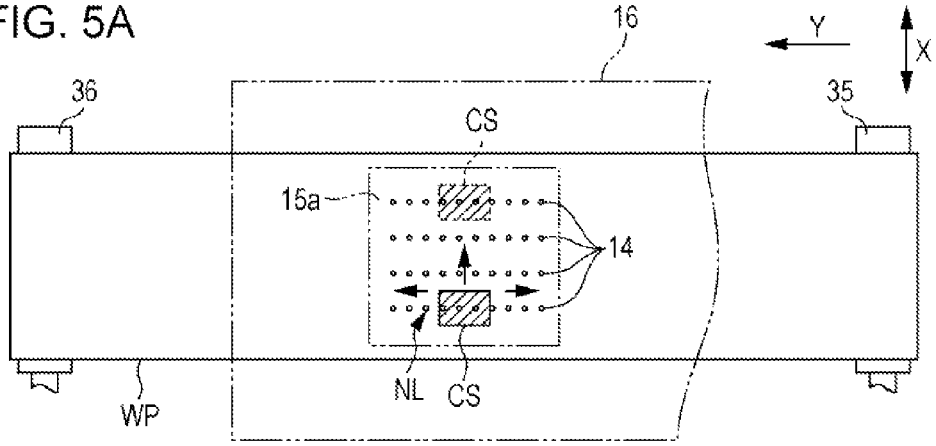
FIG. 5A is a plan view showing the movement of a contact area in the first contact state in the nozzle formation surface.
Figure 5B:
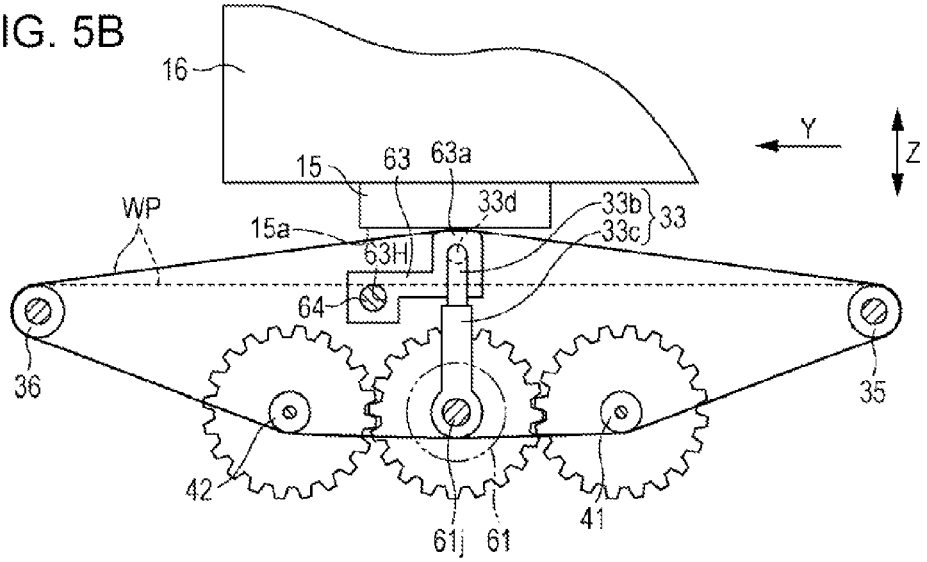
FIG. 5B is a pattern side view of the wiper unit that has a movement mechanism which moves the contact member along the nozzle formation surface.
Figure 5C:
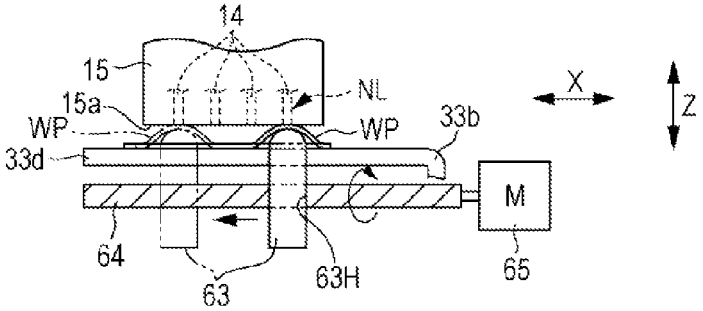
FIG. 5C is a pattern view of the movement mechanism of the contact member.

In the modification example, a slide member 63 that can be relatively moved in the main scanning direction X along the nozzle formation surface 15*a* with respect to the cloth wiper WP may be configured to be provided at the other end of the third arm member 33, as shown in FIGS. 5A to 5C, as an example of the contact member to take the place of the third rotary roller 33*a*.

In the modification example, the cloth wiper WP is in contact with the nozzle formation surface 15*a* in a contact area CS that has a predetermined width corresponding to one of the nozzle columns 14 in the main scanning direction X and has a predetermined length corresponding to a predetermined number of nozzles NL in the sub-scanning direction Y as shown in the hatching area in FIG. 5A. As shown with the solid line arrow in FIG. 5A, the contact area CS is moved along the main scanning direction X to select the nozzle column 14 that is the cleaning target or is moved along the sub-scanning direction Y to select one of the nozzle columns 14 and the nozzle NL in the nozzle column 14 that is the cleaning target.

As shown in FIGS. 5B and 5C, the slide member 63 through which a round bar-shaped guide bar 33*d* extending along the main scanning direction X passes and which slides along the guide bar 33*d* that passes through the slide member 63 is disposed as a configuration example of a specific movement mechanism which moves the contact area CS of the modification example. In the modification example, the guide bar 33*d* is formed by bending the moving member 33*b* at an approximately right angle. An upper portion 63*a* of the slide member 63 has predetermined dimensions in the main scanning direction X and the sub-scanning direction Y and is in contact with the cloth wiper WP from the inner side of the ring to bring the cloth wiper WP into contact with the contact area CS of the nozzle formation surface 15*a*. Accordingly, the slide member 63 functions as the contact member.

A screw hole 63H that has an inner circumferential surface on which a screw (female screw) is formed is disposed in a part of the slide member 63, and a rotating screw member 64 whose outer circumferential surface has a screw (male screw) which is engaged with the female screw of the screw hole 63H is inserted to be screwed with the slide member 63. Also, a motor 65 that rotates the rotating screw member 64 is provided, and a normal rotation or reverse rotation of the motor 65 causes the rotating screw member 64 to pivot and the slide member 63 that is screwed with the rotating screw member 64 is moved in the main scanning direction X. Accordingly, the rotating screw member 64 and the motor 65 function as the contact member moving units.

FIG. 5C illustrates that the slide member 63 is moved from the state shown with the solid line to the state shown with the two-dot chain line so that the contact area CS between the cloth wiper WP and the nozzle formation surface 15*a* moves between the nozzle columns 14 at both ends in the main scanning direction X.

According to the modification example, the following effect is achieved in addition to the effects (1) to (5) of the above-described embodiment.

(6) The slide member 63 is moved according to the position of the nozzle column 14 on the nozzle formation surface 15*a* that should be cleaned, and thus the cloth wiper WP can be brought into contact with each of the nozzles NL so that the nozzle formation surface 15*a* can be appropriately cleaned.

In the embodiment, the cloth wiper WP is moved along the nozzle column 14 direction with respect to the nozzle formation surface 15*a* when the nozzle formation surface 15*a* is cleaned so as to be relatively moved with respect to the nozzle formation surface 15*a*. However, the invention is not limited thereto and the cloth wiper WP may be relatively moved in the direction crossing the nozzle columns 14. For example, the cloth wiper WP may be relatively moved along the main scanning direction X crossing the nozzle columns 14 with respect to the nozzle formation surface 15*a*.

Figure 6A:
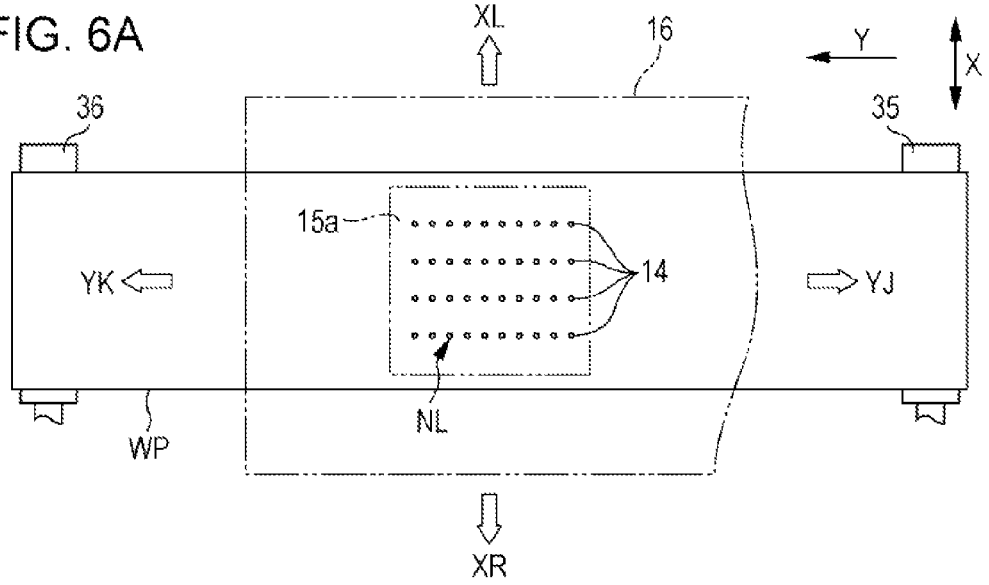

As shown in FIG. 6A, in an example of the modification example, the cloth wiper WP is relatively moved with respect to the nozzle formation surface 15*a* along the main scanning direction X which is the direction crossing the nozzle columns 14. Specifically, in the modification example, the cloth wiper WP that is in contact with the nozzle formation surface 15*a* is not moved but the carriage 16 is moved by the liquid ejecting head moving unit as shown with white arrows XL and XR in the drawing so that the liquid ejecting head 15 is moved in the direction crossing the direction in which the paper P is transported. Accordingly, the liquid ejecting head moving unit functions as the relative movement unit that relatively moves the cloth wiper WP with respect to the nozzle formation surface 15*a*.

According to the modification example, the following effect is achieved in addition to the effects (1) to (5) of the above-described embodiment and the effect (6) of the above-described modification example.

(7) The cloth wiper WP is not moved but the liquid ejecting head 15 is moved so that the cloth wiper WP can be relatively moved with respect to the nozzle formation surface 15*a*.

In the above-described embodiment, as shown with white arrows YJ and YK shown in FIG. 6A, the cloth wiper WP may be directed toward the downstream side and an upstream side in the sub-scanning direction Y along the nozzle columns 14 at the same time as when the movement of the liquid ejecting head 15 is performed so as to be moved with respect to the nozzle formation surface 15*a*.

Figure 6B:
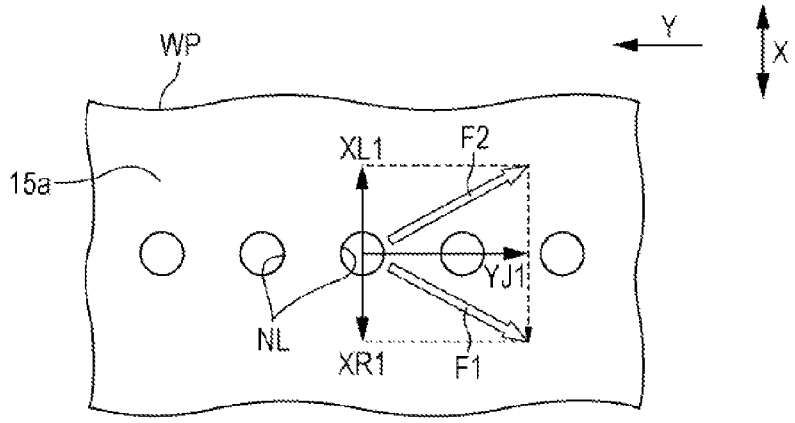

For example, as shown with solid line arrow YJ1 in FIG. 6B, the cloth wiper WP that is in contact with the nozzle formation surface 15*a* is moved toward the upstream side in the sub-scanning direction Y in the first contact state of the above-described embodiment (refer to FIG. 3A). At this time, the liquid ejecting head 15 is moved along the main scanning direction X by the liquid ejecting head moving unit as shown with arrows XR1 and XL1 at the same time as when the cloth wiper WP is moved toward the upstream side in the sub-scanning direction Y. As such, the direction of relative movement of the cloth wiper WP with respect to the nozzles NL formed on the nozzle formation surface 15*a* is changed to the white arrow F1 or F2 direction in the drawing in which arrow YJ1 is combined with arrow XR1 or arrow XL1.

Figure 6C:
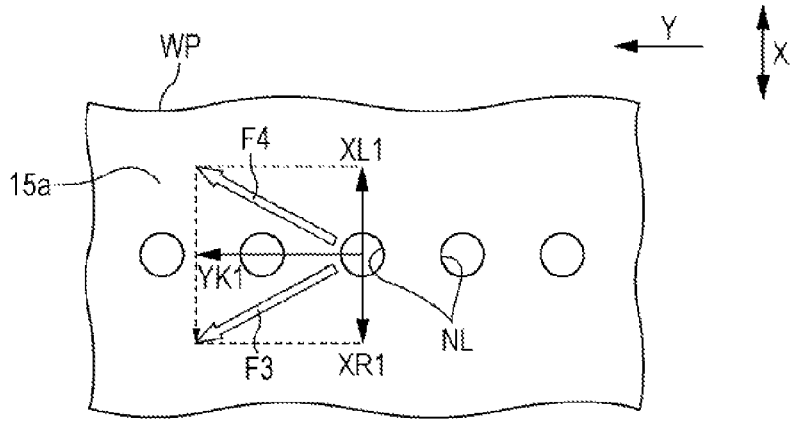

As shown with solid line arrow YK1 in FIG. 6C, the cloth wiper WP that is in contact with the nozzle formation surface 15*a* is moved toward the downstream side in the sub-scanning direction Y in the second contact state of the above-described embodiment (refer to FIG. 4A). At this time, the liquid ejecting head 15 is moved along the main scanning direction X by the liquid ejecting head moving unit as shown with solid arrows XR1 and XL1 at the same time as when the cloth wiper WP is moved toward the downstream side in the sub-scanning direction Y. As such, the direction of relative movement of the cloth wiper WP with respect to the nozzles NL formed on the nozzle formation surface 15*a* is changed to the white arrow F3 or F4 direction in the drawing in which arrow YK1 is combined with arrow XR1 or arrow XL1.

According to the modification example, the following effect is achieved in addition to the effects (1) to (5) of the above-described embodiment and the effect (6) of the above-described modification example.

(8) The liquid ejecting head 15 and the cloth wiper WP are moved at the same time, and thus the direction of relative movement between the cloth wiper WP and the nozzle formation surface 15*a* can be changed without having to be a certain direction such as the direction of movement of the liquid ejecting head 15. Accordingly, the direction in which a lyophobic surface or the like on the nozzle formation surface 15*a* is rubbed by the cloth wiper WP can be dispersed, and thus a degradation in the lyophobic performance of the nozzle formation surface 15*a* generated by the rubbing in the same direction can be prevented and the nozzle formation surface 15*a* can be appropriately cleaned by the cloth wiper WP.

In the above-described embodiment, the cloth wiper WP does not necessarily have to be moved in the direction along the nozzle columns 14. For example, in a case where only one nozzle column is formed on the nozzle formation surface 15*a*, a case where the same color of ink is ejected from all of the nozzle columns or the like, no color mixing occurs with the ink and thus the cloth wiper WP may be configured to be moved in the direction crossing the nozzle columns 14.

In the above-described embodiment, in a state where the cloth wiper WP is in contact with the nozzle formation surface 15*a*, the cloth wiper WP does not necessarily have to be relatively moved with respect to the nozzle formation surface 15*a* even if, for example, the cleaning area is narrow if the cloth wiper WP can clean the nozzle formation surface 15*a*.

In the above-described embodiment, the third rotary roller 33*a* and the slide member 63 do not necessarily have to be relatively moved along the nozzle formation surface 15*a* with respect the cloth wiper WP in a case, for example, where a position at which the nozzle formation surface 15*a* is cleaned is determined.

In the above-described embodiment, the contact members, that is, the first rotary roller 31*a* and the second rotary roller 32*a* or the third rotary roller 33*a* do not necessarily have to be provided to bring the cloth wiper WP into contact with the nozzle formation surface 15*a* in either one of the first contact state and the second contact state. For example, the cloth wiper WP may be configured to be brought into contact with the nozzle formation surface 15*a* in either one of the first contact state and the second contact state by moving the entire wiper unit 30 along the vertical direction Z.

In the above-described embodiment, the liquid ejecting head 15 may be configured to eject the ink (liquid) to the paper P at a fixed position instead of being moved in the main scanning direction X. In this case, it is preferable that the wiper unit 30 be configured to be movable in the main scanning direction X.

In the above-described embodiment, the width dimension of the cloth wiper WP along the main scanning direction X crossing the sub-scanning direction Y in which the cloth wiper WP is turned and moved may be smaller than the length dimension of the nozzle formation surface 15*a* along the main scanning direction X.

Figure 7:
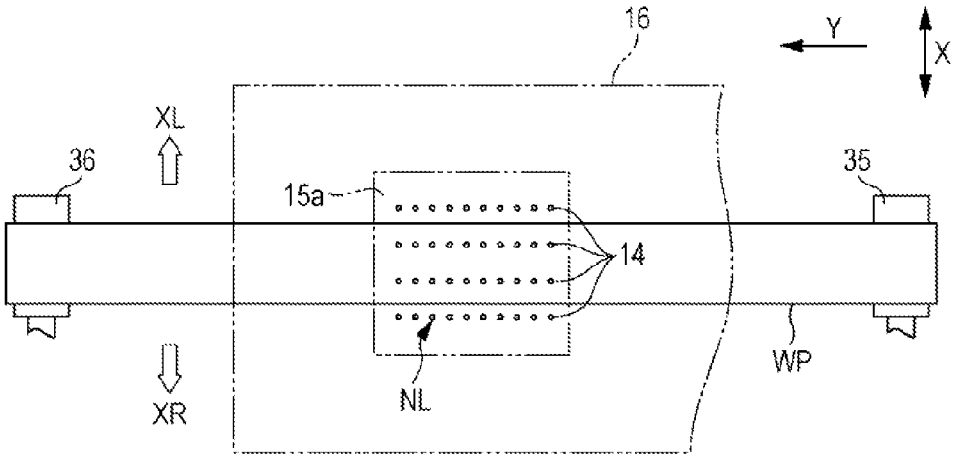
FIG. 7 is a pattern plan view of a wiper unit that has a cloth wiper of a modification example.

As an example is shown in FIG. 7, the cloth wiper WP (wiper unit 30) may be moved along the main scanning direction X in these cases as shown with white arrows XR and XL in the drawing, and the liquid ejecting head 15 may be moved along the main scanning direction X.

In the above-described embodiment, the first gear 41G may be configured to be connected to the roller shaft of the paper feed roller 22 so as to be directly rotated by the rotation of the paper feed roller 22, not via the transmission gear 22G. Also, the second gear 42G may be configured to be rotated by the paper discharge roller 23 instead of the first gear 41G.

In the above-described embodiment, the number of the intermediate gear 43G may be an even number. In this case, the first gear 41G and the second gear 42G rotate in the reverse directions to each other, and thus the first arm member 31 and the second arm member 32 oscillate synchronously in the reverse directions to each other. Accordingly, the angular contact pins 51*a* and 51*b* or the angular contact pins 52 and 52*b* are arranged at positions matching the oscillation in the reverse directions.

In the above-described embodiment, the first gear 41G (second gear 42G) may not be rotated by the paper feed roller 22 (transmission gear 22G). For example, the first gear 41G may be rotated by a dedicated driving source.

In the above-described embodiment, the cloth wiper WP may be provided in the wiper unit 30 not in the endless belt-shape but in a shape in which a long cloth is unwound from a state where the long cloth is wound in a roll shape, is brought in contact with the nozzle formation surface 15*a*, and then is wound again in a roll shape.

In the above-described embodiment, when the cloth wiper WP is moved along the sub-scanning direction Y, there is no problem even if the wiper unit 30 itself is moved. In this case, the cloth wiper WP can be moved also toward the upstream side unlike in the case where the direction of movement of the cloth wiper WP is limited to the downstream side in the sub-scanning direction Y in the second contact state of the above-described embodiment where the cloth wiper WP is in contact with the whole area of the nozzle formation surface 15*a*.

In the above-described embodiment, the belt-shaped member does not necessarily have to be limited to the cloth wiper WP but may be a member formed of porous rubber, a resin material, or the like. Any material can be used in the belt-shaped member if the material can capture the ink (liquid) ejected from the liquid ejecting head 15.

In the above-described embodiment, the printer 11 may be a liquid ejecting apparatus that ejects or discharges a liquid other than ink. The liquid that is discharged in the form of a small amount of droplets from the liquid ejecting apparatus while leaving a trail is granular-shaped, tear-shaped, thread-shaped or the like. The liquid described herein may be formed of a material that can be ejected from the liquid ejecting apparatus. The material may be in a liquid phase state, examples of which include flowing bodies such as a liquid, sol, gel water, inorganic solvent, organic solvent, solution, liquid resin, and liquid metal (metallic melt) with high or low viscosity. Also, the material may not be in a liquid state but may be in a state where functional material particles formed of a solid material such as a pigment and a metallic particle are dissolved, dispersed, or mixed in a solvent. Representative examples of the liquid include the ink in the above-described embodiment and liquid crystals. Herein, examples of the ink include various liquid compositions such as water-based ink, oil-based ink, gel ink, and hot melt ink in general. Specific examples of the liquid ejecting apparatus include liquid ejecting apparatuses that eject the liquid containing an electrode material, a coloring material, or the like dispersed or dissolved therein, the material being used to produce liquid crystal display, electroluminescence (EL) display, surface-emitting display, color filters, and the like. Also, the liquid ejecting apparatus may be a liquid ejecting apparatus that ejects a bio-organic material which is used to produce bio-chips, a liquid ejecting apparatus that ejects a liquid which is a sample used as a precision pipette, a textile printing apparatus, and a micro dispenser. Further, the liquid ejecting apparatus may be a liquid ejecting apparatus that ejects a lubricant in a pinpoint manner onto precision machinery such as clocks and cameras, and a liquid ejecting apparatus that ejects a transparent resin solution such as an ultraviolet curable resin onto a substrate so as to form micro hemispherical lenses (optical lenses) and the like used in optical communication devices and the like. Also, the liquid ejecting apparatus may be a liquid ejecting apparatus that ejects an etching solution such as acid and alkali so as to etch a substrate or the like.

The entire disclosure of Japanese Patent Application No. 2012-245103, filed Nov. 7, 2012 is expressly incorporated by reference herein.

What is claimed is:

1. A liquid ejecting apparatus comprising:

a liquid ejecting head that includes a nozzle formation surface on which a plurality of nozzles which eject a liquid to an ejection target medium which is transported are formed to be lined up in one direction to form nozzle columns;

a belt-shaped member that is provided to be capable of being in contact with the nozzle formation surface and to be brought into contact with the nozzle formation surface so as to be capable of capturing the liquid from the nozzle formation surface; and a belt-shaped member contact portion that brings the belt-shaped member into contact with the nozzle formation surface in both a first contact state where the belt-shaped member is brought into contact with a partial area of the nozzle formation surface and a second contact state where the belt-shaped member is in contact with an area corresponding to the nozzle column in a direction along the nozzle column on the nozzle formation surface by moving the belt-shaped member from a separation position where the belt-shaped member is not in contact with the nozzle formation surface.

2. The liquid ejecting apparatus according to claim 1, wherein the belt-shaped member contact portion includes a contact member that is in contact with the belt-shaped member from the side opposite to a side on which the nozzle formation surface is in contact with the belt-shaped member so that the belt-shaped member is in contact with the nozzle formation surface in either one of the first contact state and the second contact state.

3. The liquid ejecting apparatus according to claim 2, wherein the belt-shaped member contact portion further includes a contact member moving unit that relatively moves a contact member along the nozzle formation surface with respect to the belt-shaped member.

4. The liquid ejecting apparatus according to claim 1, wherein the belt-shaped member contact portion includes a relative movement unit that relatively moves the belt-shaped member with respect to the nozzle formation surface in a state where the belt-shaped member is in contact with the nozzle formation surface.

5. The liquid ejecting apparatus according to claim 4, wherein the relative movement unit has a belt-shaped member moving unit that moves the belt-shaped member in the direction along the nozzle column.

6. The liquid ejecting apparatus according to claim 4, wherein the relative movement unit has a liquid ejecting head moving unit that moves the liquid ejecting head in the direction crossing the direction in which the ejection target medium is transported.

7. The liquid ejecting apparatus according to claim 6, wherein the liquid ejecting head is moved by the liquid ejecting head moving unit and the belt-shaped member is moved by the belt-shaped member moving unit in the direction crossing the direction of movement of the liquid ejecting head by the liquid ejecting head moving unit in the relative movement unit.

* * * * *